US011170720B2

(12) United States Patent
Chiang et al.

(10) Patent No.: US 11,170,720 B2
(45) Date of Patent: Nov. 9, 2021

(54) DISPLAY PANEL DRIVING APPARATUS AND DRIVING METHOD THEREOF

(71) Applicant: Novatek Microelectronics Corp., Hsinchu (TW)

(72) Inventors: Pang-Jen Chiang, Hsinchu (TW); Jen-Chieh Hu, Hsinchu County (TW); Chin-Hung Hsu, Taoyuan (TW)

(73) Assignee: Novatek Microelectronics Corp., Hsinchu (TW)

( * ) Notice: Subject to any disclaimer, the term of this patent is extended or adjusted under 35 U.S.C. 154(b) by 209 days.

(21) Appl. No.: 16/028,429

(22) Filed: Jul. 6, 2018

(65) Prior Publication Data

US 2020/0013343 A1 Jan. 9, 2020

(51) Int. Cl.

| | |
|---|---|
| ***G09G 3/3275*** | (2016.01) |
| ***G09G 3/36*** | (2006.01) |
| ***G09G 3/20*** | (2006.01) |

(52) U.S. Cl.

CPC ..... *G09G 3/3275* (2013.01); *G09G 3/2007* (2013.01); *G09G 3/3688* (2013.01); *G09G 2310/08* (2013.01); *G09G 2320/0276* (2013.01)

(58) Field of Classification Search

CPC combination set(s) only.
See application file for complete search history.

(56) References Cited

U.S. PATENT DOCUMENTS

| | | | | |
|---|---|---|---|---|
| 2012/0098813 | A1* | 4/2012 | Park | G09G 3/3677 345/211 |
| 2015/0379947 | A1* | 12/2015 | Sang | G09G 3/3614 349/37 |
| 2018/0182279 | A1* | 6/2018 | Sakariya | G09G 3/2018 |

* cited by examiner

*Primary Examiner* — Ifedayo B Iluyomade
(74) *Attorney, Agent, or Firm* — JCIPRNET

(57) ABSTRACT

The invention provides a display panel driving apparatus and a driving method thereof. The display panel driving apparatus includes a source driver circuit and a timing controller circuit. The source driver circuit loads data to data lines of the display panel in load data periods. The timing controller circuit controls the source driver circuit for dynamically configuring a time length of one of the load data periods according to whether charge sharing occurs. When a charge sharing operation is not performed on at least two of the data lines in the load data period, the load data period has a first time length. When the charge sharing operation is performed on at least two of the data lines in the load data period, the load data period has a second time length longer than the first time length.

20 Claims, 10 Drawing Sheets

DISPLAY PANEL DRIVING APPARATUS AND DRIVING METHOD THEREOF

BACKGROUND

Field of the Invention

The invention relates to a display apparatus and more particularly to a display panel driving apparatus and a driving method thereof.

Description of Related Art

FIG. 1 is a schematic circuit block diagram illustrating a display apparatus 100 of the related art. The display apparatus 100 includes a timing controller 110, a plurality of source drivers (for example, source drivers S-IC_1, S-IC_2, S-IC_3, S-IC_4, . . . and S-IC_i illustrated in FIG. 1), a plurality of gate drivers (for example, gate drivers G-IC_1, G-IC_2, . . . and G-IC_j illustrated in FIG. 1) and a display panel 140. The display panel 140 may be a thin film transistor liquid crystal display (TFT-LCD) panel or other display panels.

The timing controller 110 transmits a plurality of gate control signals (for example, a clock signal CPV, a frame start signal STV and an output shielding signal OE illustrated in FIG. 1) to the gate drivers G-IC_1 to G-IC_j, so as to control the gate drivers G-IC_1 to G-IC_j. Based on the control of the timing controller 110, the gate drivers G-IC_1 to G-IC_j output scan signals having different phases to different scan lines (which are gate lines, but not shown in FIG. 1) of the display panel 140. The timing controller 110 transmits a plurality of source control signals (for example, a load data signal LD and a polarity signal POL as illustrated in FIG. 1) to the source drivers S-IC_1 to S-IC_i so as to control the source drivers S-IC_1 to S-IC_i. In accordance with a scan timing sequence of the gate drivers G-IC_1 to G-IC_j, the source drivers S-IC_1 to S-IC_i may synchronously output driving signals to different data lines (which are source lines, but not shown in FIG. 1) of the display panel 140. The driving signals provided by the source drivers S-IC_1 to S-IC_i may drive the display panel 140 to display an image.

FIG. 2 is a schematic equivalent circuit diagram illustrating the display panel 140 depicted in FIG. 1. FIG. 2 illustrates equivalent circuits of two data lines of the display panel 140, wherein each of the data lines has a plurality of equivalent resistors R and a plurality of equivalent capacitors C. The upper part of the display panel 140 illustrated in FIG. 2 represents the equivalent circuit of one of the data lines, wherein a node A1 represents a node which is close to one of the source drivers (e.g., the source driver S-IC_1) in the data line, and a node B1 represents a node which is far away from the source driver S-IC_1 in the same data line. The lower part of the display panel 140 illustrated in FIG. 2 represents the equivalent circuit of the other data line, wherein a node A2 represents a node which is close to one of the source drivers (e.g., the source driver S-IC_1) in the other data line, and a node B2 represents a node which is far away from the source driver S-IC_1 in the same data line.

The source driver S-IC_1 illustrated in FIG. 2 has a driving circuit 211, a driving circuit 212, a switch S1, a switch S2 and a switch S3. When the source driver S-IC_1 is operated in a charge sharing period, the switches S1 and S2 are turned off, and the switch SW3 is turned on. When the source driver S-IC_1 is operated in a line driving period, the switches S1 and S2 are turned on, and the switch SW3 is turned off. Thus, the drive circuits 211 and 212 may respectively output the driving signals thereof to different data lines of the display panel 140.

FIG. 3 is a schematic timing diagram illustrating voltage levels of different positions in the data lines depicted in FIG. 2. Referring to FIG. 2 and FIG. 3, when the source driver S-IC_1 is operated in a charge sharing period PCS, the switches S1 and S2 are turned off, and the switch SW3 is turned on. Thus, voltage levels of the node A1 and the node A2 are close to each other, and voltage levels of the node B1 and the node B2 are also close to each other. When the source driver S-IC_1 is operated in a line driving period PDD, the switches S1 and S2 are turned on, and the switch SW3 is turned off. Thus, the drive circuits 211 and 212 may respectively output the driving signals thereof to different data lines of the display panel 140.

However, due to effects from the equivalent resistors R and the equivalent resistors C, transition speeds of voltages of the nodes B1 and B2 are slower than transition speeds of voltages of the nodes A1 and A2. The longer the data lines are, the more obvious such phenomenon is. According to FIG. 3, there may be not enough time for the nodes B1 and B2 to complete the charge sharing operation. Namely, an efficiency of the charge sharing between the nodes B1 and B2 is not sufficiently utilized. As for the conventional driving manner, the time for the charge sharing is short, and therefore, the efficiency of the charge sharing is incapable of being sufficiently utilized, which may result in increased power-consumption of the source drivers.

SUMMARY

The invention provides a display panel driving apparatus and a driving method thereof which can increase the time for charge sharing, such that the efficiency of charge sharing can be sufficiently utilized.

According to an embodiment of the invention, a display panel driving apparatus is provided. The display panel driving apparatus includes a source driver circuit and a timing controller circuit. The source driver circuit is configured to be coupled to a plurality of data lines of a display panel. A same frame period includes a plurality of load data periods. The source driver circuit loads a plurality of data to the data lines in the load data periods. The timing controller circuit is configured to control the source driver circuit. The source driver circuit dynamically configuring a time length of one of the load data periods according to whether charge sharing occurs. When a charge sharing operation is not performed on at least two of the data lines in the load data period, the load data period has a first time length. When the charge sharing operation is performed on at least two of the data lines in the load data period, the load data period has a second time length longer than the first time length.

According to an embodiment of the invention, a source driver circuit is provided. The source driver circuit includes a receiving circuit and a driving circuit. The receiving circuit is configured to receive a polarity signal and a load data signal from a timing controller circuit. The polarity signal indicates whether a charge sharing is performed on at least two of the data lines of the display panel or not. A same frame period of the load data signal includes a plurality of load data periods. The source driver circuit loads data in the load data periods. The driving circuit is configured to be connected between the receiving circuit and a plurality of data lines of the display panel. When the polarity signal indicates that a charge sharing operation is not performed on at least two of the data lines, the driving circuit does not extend the load data period, such that the load data period has a first time length. When the polarity signal indicates that the charge sharing operation is performed on at least two of the data lines, the driving circuit extends the load data period to have a second time length longer than the first time length.

According to an embodiment of the invention, a driving method of a display panel is provided. The driving method further includes: loading data to a plurality of data lines of the display panel in a plurality of load data periods of a same frame period; and dynamically configuring a time length of one of the load data periods according to whether charge sharing occurs. When a charge sharing operation is not performed on at least two of the data lines in the load data period, the load data period has a first time length. When the charge sharing operation is performed on at least two of the data lines in the load data period, the load data period has a second time length longer than the first time length.

According to an embodiment of the invention, a driving method of a display panel is provided. The driving method further includes: receiving a polarity signal and a load data signal from a timing controller circuit, wherein the polarity signal indicates whether a charge sharing operation is performed on at least two of the data lines of the display panel or not, wherein one frame period of the load data signal comprises a plurality of load data periods, and the source driver circuit loads data in the load data periods; when the polarity signal indicates that a charge sharing operation is not performed on at least two of the data lines, not extending the load data period, such that the load data period has a first time length; and when the polarity signal indicates that the charge sharing operation is performed on at least two of the data lines, extending the load data period, such that the load data period has a second time length longer than the first time length.

To sum up, the display panel driving apparatus and the driving method thereof provided by the embodiments of the invention can extend the load data periods to prolong the time for the charge sharing. Therefore, the efficiency of the charge sharing can be sufficiently utilized.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
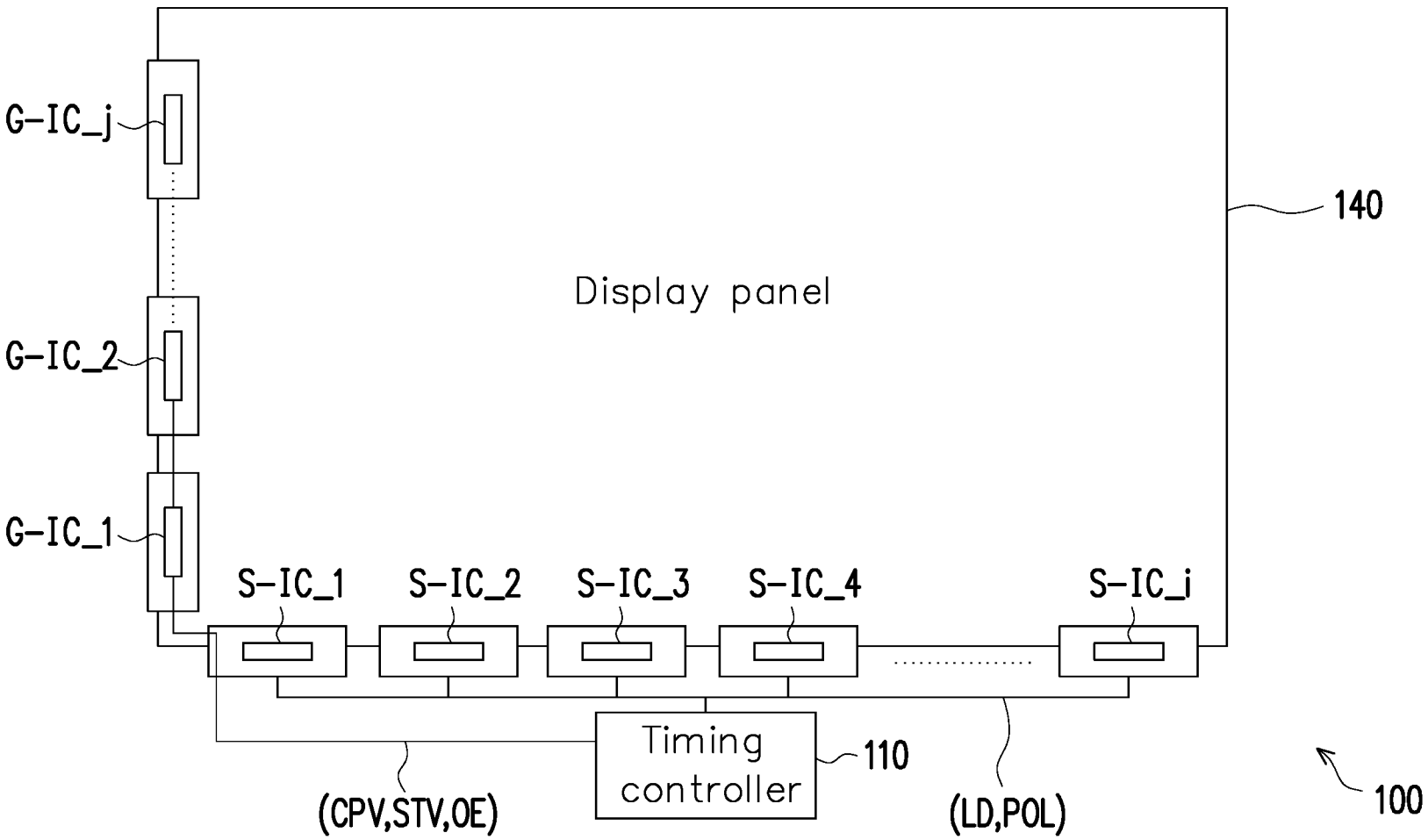
FIG. 1 is a schematic circuit block diagram illustrating a display apparatus of the related art.

The term "couple (or connect)" herein (including the claims) are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. Moreover, elements/components/steps with same reference numerals represent same or similar parts in the drawings and embodiments. Elements/components/notations with the same reference numerals in different embodiments may be referenced to the related description.

Figure 4:
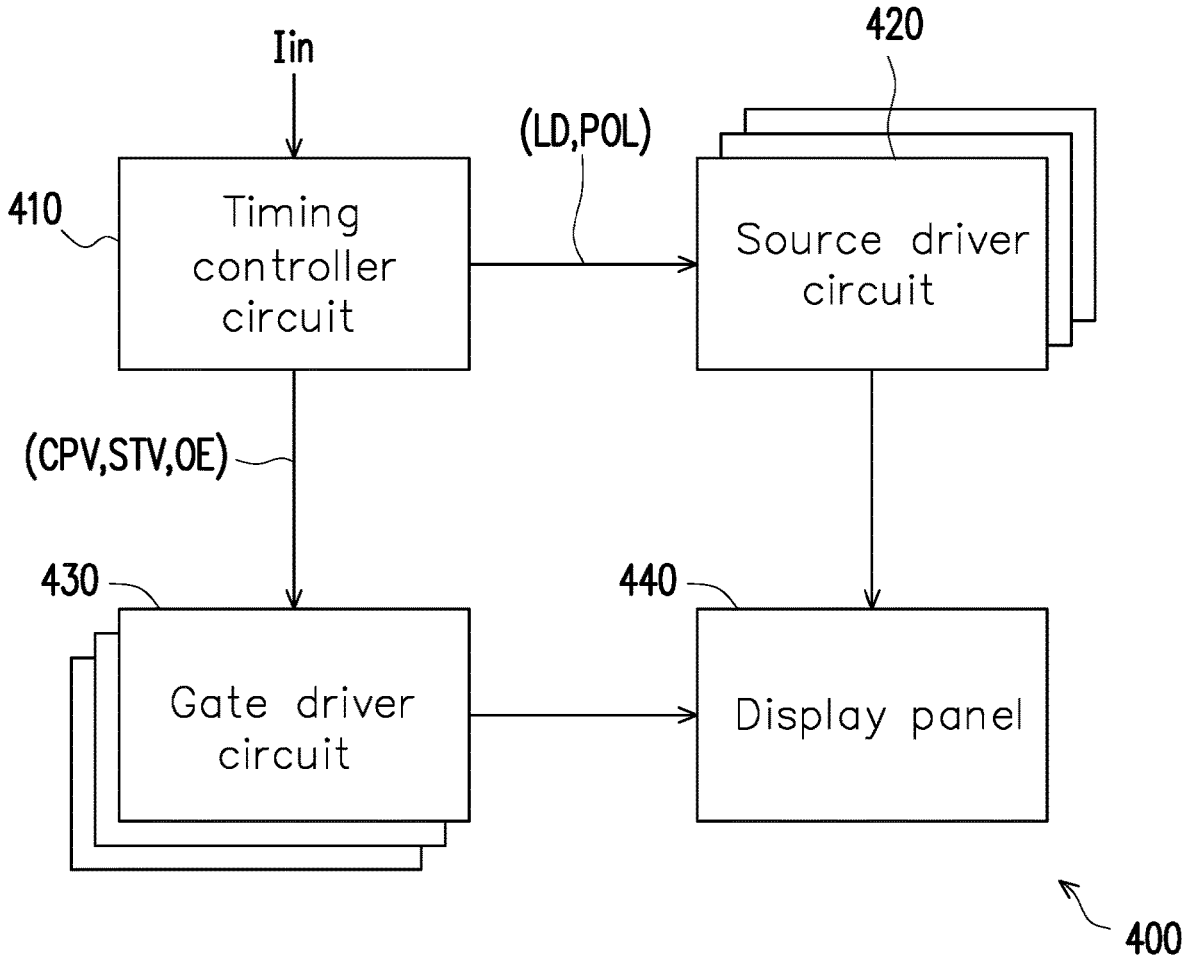
FIG. 4 is a schematic circuit block diagram illustrating a display panel driving apparatus according to an embodiment of the invention.

FIG. 4 is a schematic circuit block diagram illustrating a display panel driving apparatus 400 according to an embodiment of the invention. The display panel driving apparatus 400 includes a timing controller circuit 410 and a source driver circuit 420. The display driving apparatus 400 may further comprise a gate driver circuit 430. The display panel driving apparatus 400 is configured to drive a display panel 440. The display panel 440 may be a thin film transistor liquid crystal display (TFT-LCD) panel, an light-emitting diode (LED) display panel such as an organic LED (OLED) display panel or other display panels. The timing controller 410 may transmit a plurality of gate control signals (for example, a clock signal CPV, a frame start signal STV and an output shielding signal OE as illustrated in FIG. 4) to the gate driver circuit 430, so as to control the gate driver circuit 430. Based on the control of the timing controller circuit 410, the gate driver circuit 430 outputs scan signals having different phases to different scan lines (which are also referred to as gate lines, but not shown in FIG. 4) of the display panel 440. In different implementations, the timing controller circuit 410, the source driver circuit 420 and the gate driver circuit 430 may be separated may be separated into different integrated circuits or at least partially integrated.

Figure 2:
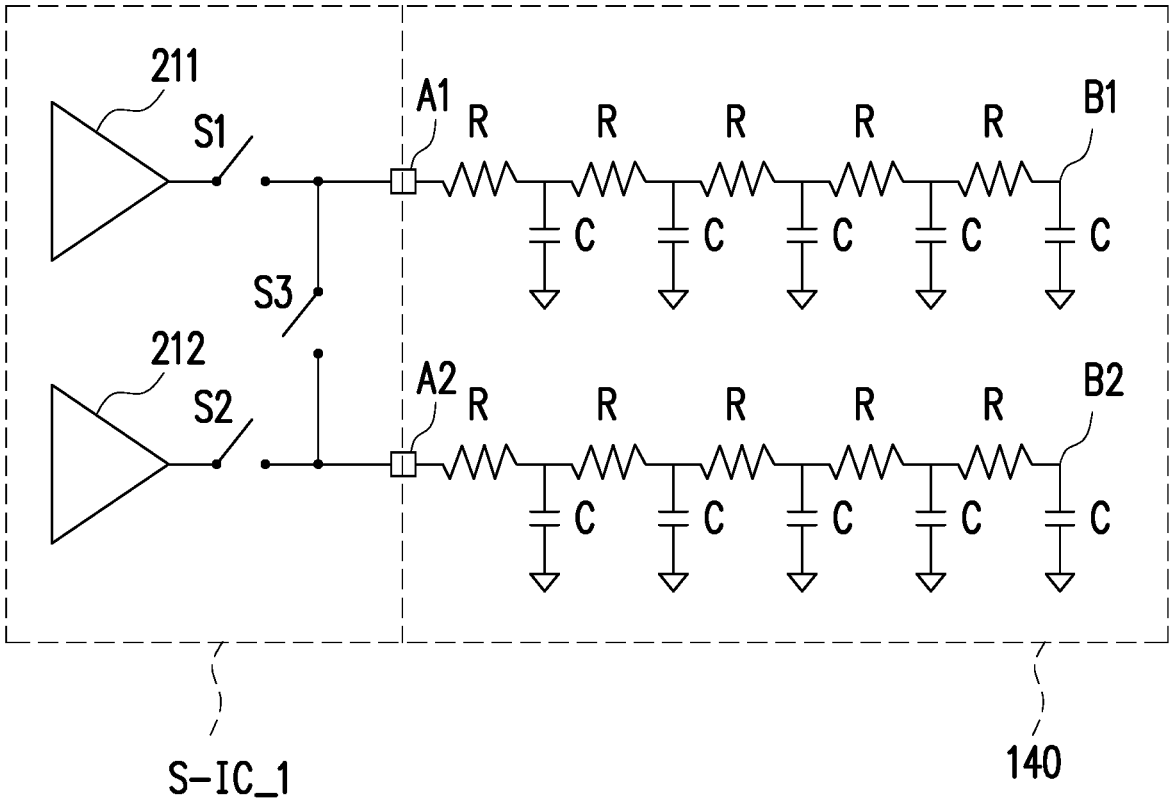
FIG. 2 is a schematic equivalent circuit diagram illustrating the display panel depicted in FIG. 1.
Figure 3:
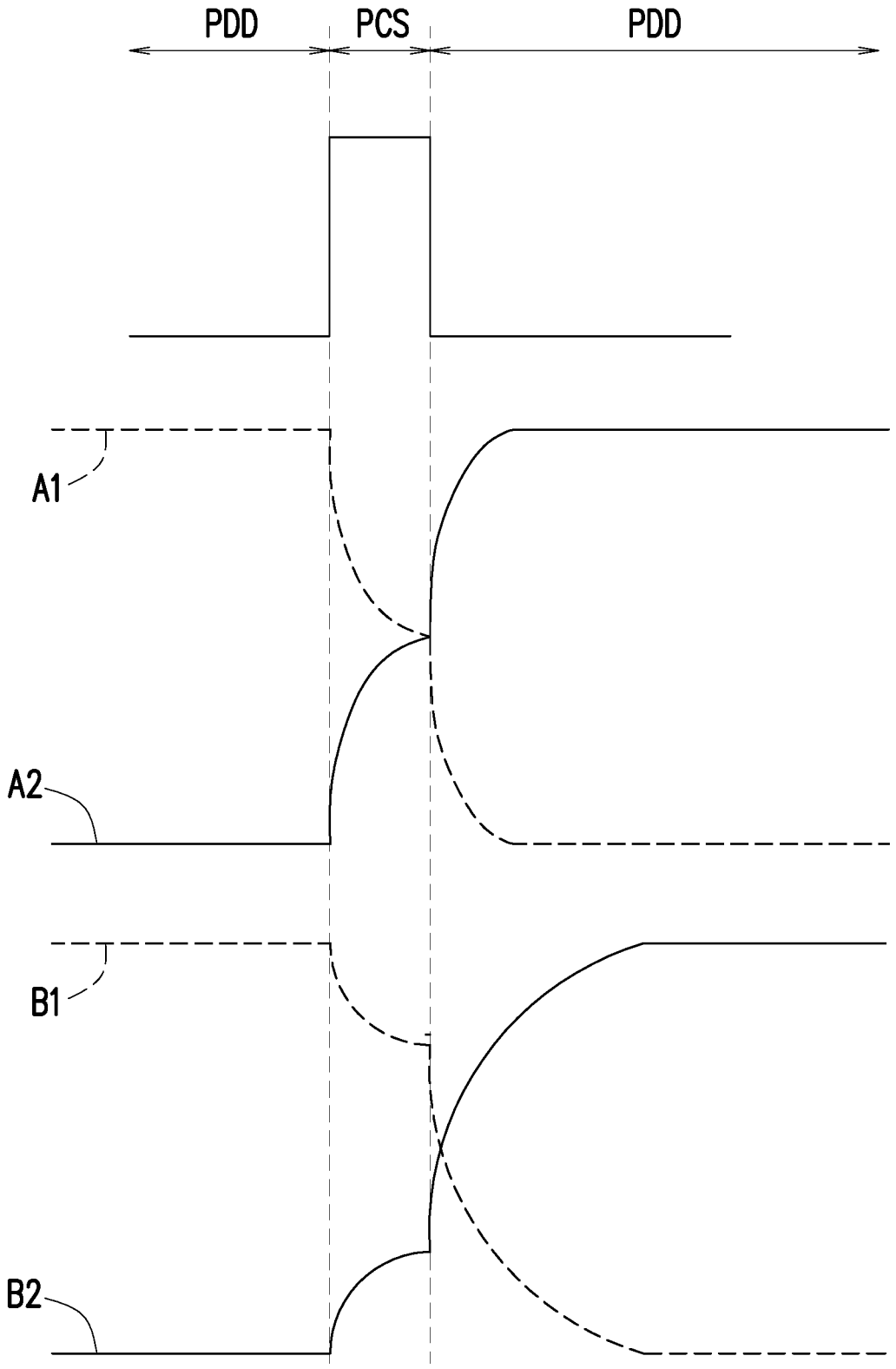
FIG. 3 is a schematic timing diagram illustrating voltage levels of different positions in the data lines depicted in FIG. 2.

The timing controller 410 transmits a plurality of source control signals (for example, a load data signal LD and a polarity signal POL as illustrated in FIG. 4) to the source driver circuit 420, so as to control the source driver circuit 420. The source driver circuit 420 is configured to be coupled to a plurality of data lines (which are also referred to as source lines, but not shown in FIG. 4) of the display panel 440. Under the control of the timing controller 410, the source driver circuit 420 may synchronously output a plurality of driving signals to different data lines (which are not shown in FIG. 4) of the display panel 440 in accordance with a scan timing sequence of the gate driver circuit 430. The driving signal provided by the source driver circuit 420 may drive the display panel 440 to display an image. The descriptions related to FIG. 1 and FIG. 2 may also be applicable to the display panel 440 depicted in FIG. 4.

Figure 5:
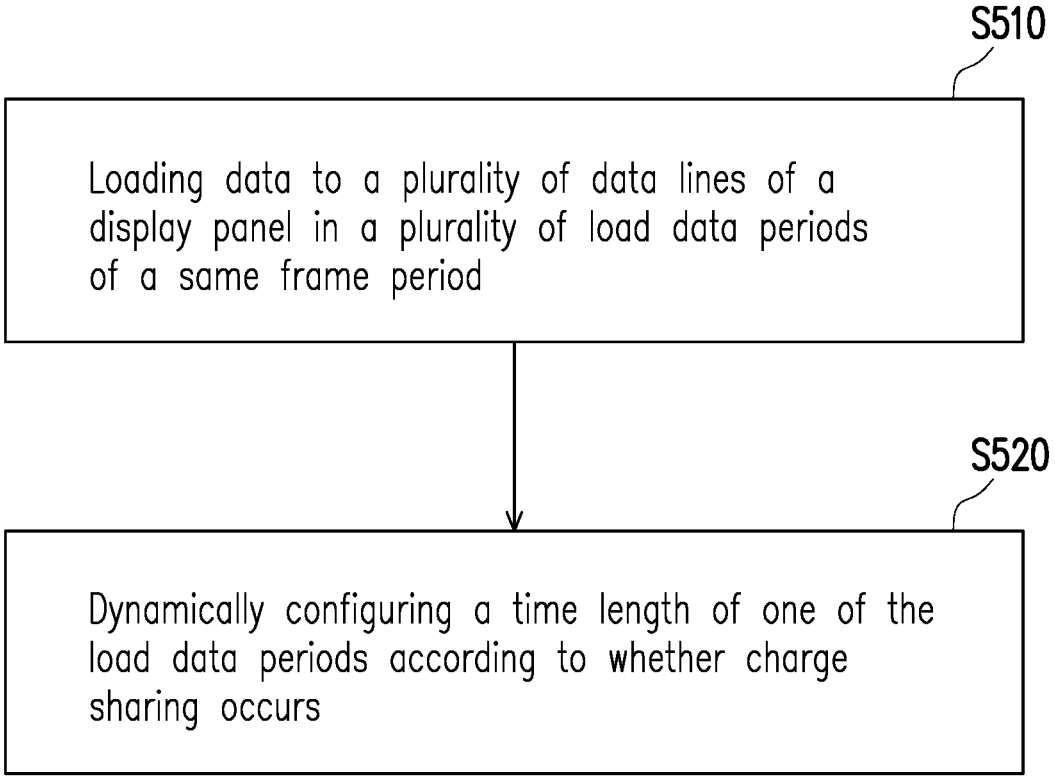
FIG. 5 is a flowchart illustrating a driving method of a display panel according to an embodiment of the invention.

FIG. 5 is a flowchart illustrating a driving method of a display panel according to an embodiment of the invention. Referring to FIG. 4 and FIG. 5, generally, a same frame period includes a plurality of load data periods and a plurality of line driving periods which may be arranged immediately next to the load data periods. In step S510, the source driver circuit 420 loads a plurality of data to the data lines in the load data periods and provides a plurality of driving signals for driving the data lines in the line driving periods, such that the display panel 440 display the image based on the data loaded in the load data periods.

In step S520, the source driver circuit 420 dynamically configures a time length of a load data period according to whether charge sharing occurs. For example, when a charge sharing operation is not performed on at least two of the data lines in certain one of the load data periods, the aforementioned "certain one of the load data periods" is configured to have a first time length. When a charge sharing operation is performed on at least two of the data lines in certain one of the load data periods, the aforementioned "certain one of the load data periods" is configured to have a second time length which is longer than the first time length.

Figure 6:
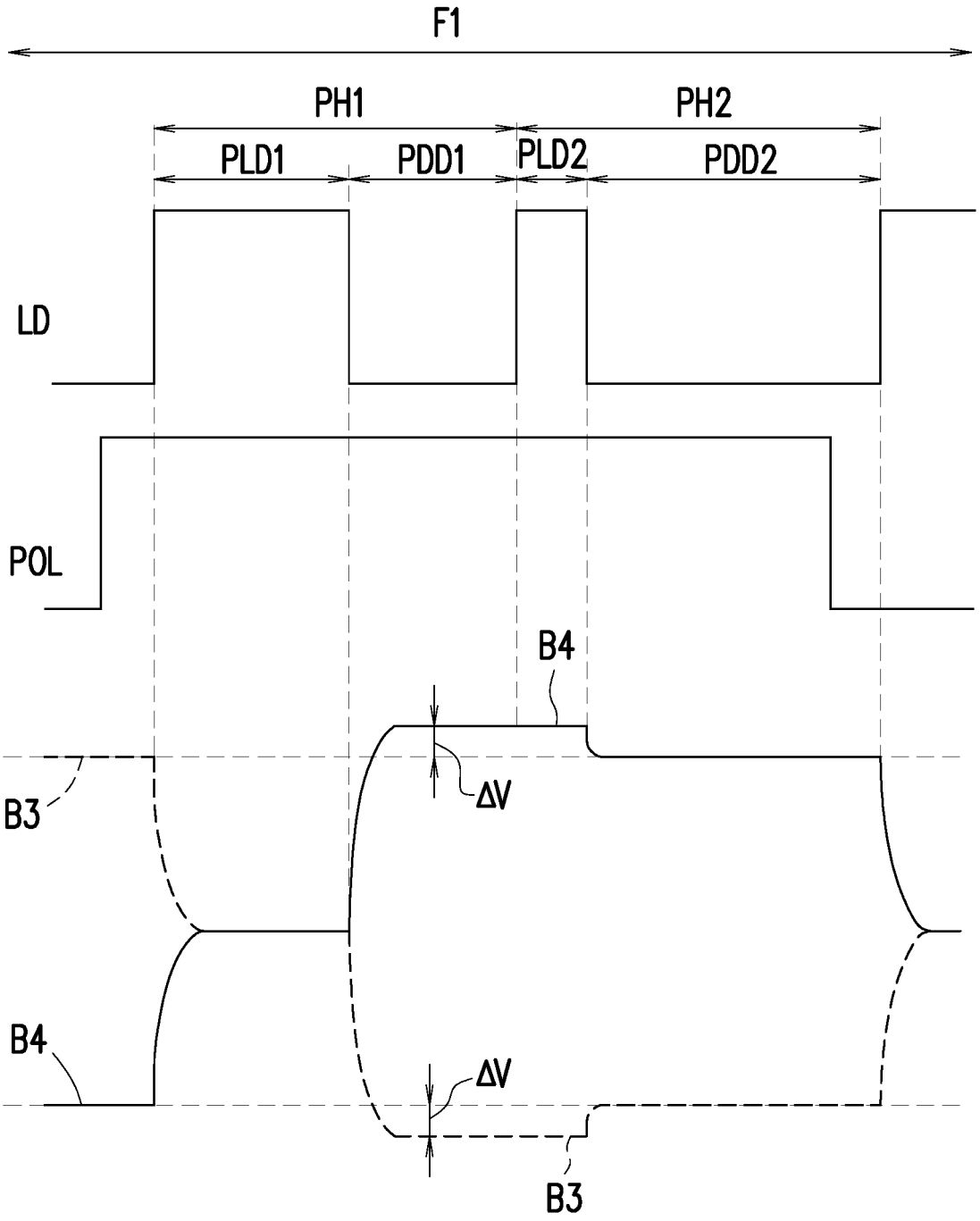
FIG. 6 is a schematic waveform diagram illustrating the load data signal and the polarity signal depicted in FIG. 4 according to an embodiment of the invention.

For example, FIG. 6 is a schematic waveform diagram illustrating the load data signal LD and the polarity signal POL depicted in FIG. 4 according to an embodiment of the invention. Generally, a same frame period F1 includes a plurality of horizontal periods (or referred to as scan periods, e.g., horizontal periods PH1 and PH2 as illustrated in FIG. 6). Each of the horizontal periods includes a load data period and a line driving period, for example, the horizontal period PH1 includes a load data period PLD1 and a line driving period PDD1, and the horizontal period PH2 includes a load data period PLD2 and a line driving period PDD2. The timing controller circuit 410 may output the load data signal LD transiting between a first level and a second level. The first level may indicate/define a load data period (for example, PLD1 or PLD2) and the second level may indicate/define a line driving period (for example, PDD1 or PDD2).

The timing controller circuit 410 may also output the polarity signal POL to the source driver circuit 420. The polarity signal POL is a control signal known in the art and thus, will not be repeatedly described. The source driver circuit 420 may determine whether to a charge sharing operation is performed on at least two of the data lines of the display panel 440 based on the polarity signal POL. For example (but not limited to), when a level of the load data signal LD rises, the source driver circuit 420 may detect whether the polarity signal POL changes at a rising edge of the load data signal LD. In response to the detection, the source driver circuit 420 may configure a time length of at least one of the load data periods (e.g., PLD1 or PLD2) of the load data signal LD.

Taking FIG. 6 for example, when the polarity signal POL changes at the rising edge of the load data signal LD, the source driver circuit 420 may perform the charge sharing operation on the data lines of the display panel 440 in the load data period PLD1. Because the charge sharing operation is performed in the load data period PLD1, the source driver circuit 420 may configure the time length of the load data period PLD1 to be the "second time length". The "second time length" may be determined based on a design requirement. For example (but not limited to), the timing controller circuit 410 may obtain the "second time length" from a look-up table according to an input current Iin of the timing controller circuit 410.

Figure 7:
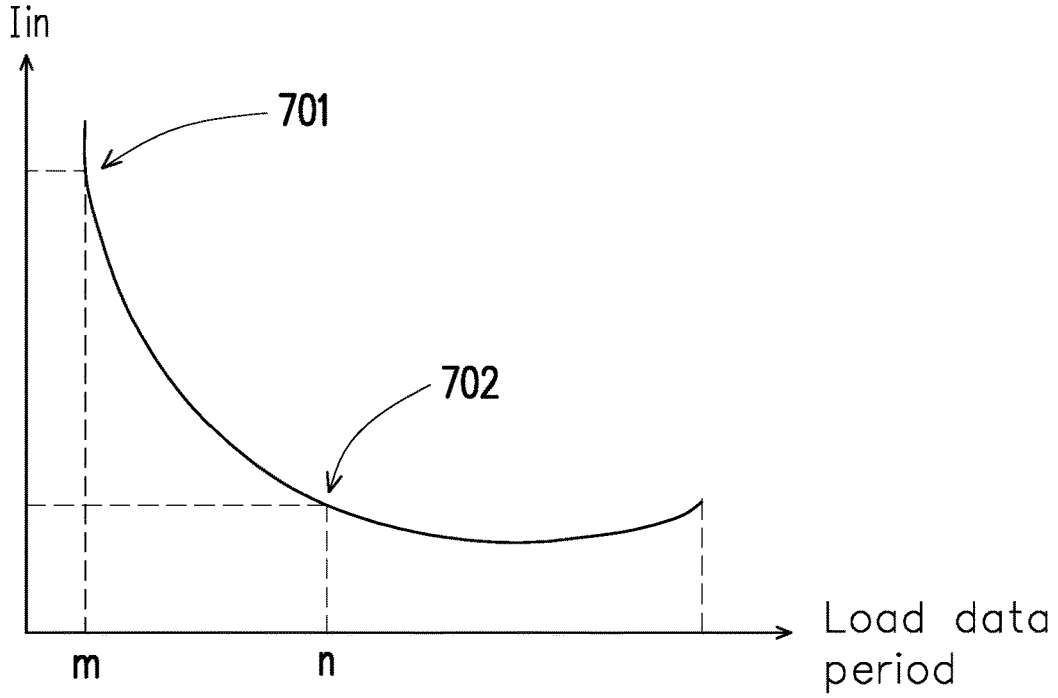
FIG. 7 is a schematic graph illustrating a relationship between the input current of the timing controller circuit and the time length of the load data period according to an embodiment of the invention.

FIG. 7 is a schematic graph illustrating a relationship between the input current Iin of the timing controller circuit and the time length of the load data period according to an embodiment of the invention. The horizontal axis illustrated in FIG. 7 represents the time length of the load data period in a unit of microsecond (ms). The vertical axis illustrated in FIG. 7 represents the input current Iin of the timing controller circuit 410 in a unit of ampere (AMP). A curve point 701 illustrated in FIG. 7 represents that an original time length of the load data period PLD1 is m. When the charge sharing operation is performed on the data lines of the display panel 440 in the load data period PLD1, the source driver circuit 420 may, according to the input current Iin of the timing controller circuit 410, obtain a new time length n (i.e., the second time length) of the load data period PLD1 in which the charge sharing occurs from the curve illustrated in FIG. 7. A curve point 702 illustrated in FIG. 7 represents that the new time length of the load data period PLD1 is n.

When the polarity signal POL changes at the rising edge of the load data signal LD, the source driver circuit 420 may not perform the charge sharing operation on the data lines of the display panel 440 in the load data period PLD2. Because the charge sharing operation is not performed in the load data period PLD2, the source driver circuit 420 may configure the time length of the load data period PLD2 to have the "first time length". The "first time length" may be determined based on a design requirement, wherein the "first time length" is shorter than the "second time length". Thus, the source driver circuit 420 may configure the time length of the load data period (e.g., PLD1 or PLD2) of the load data signal LD in response to the polarity signal POL.

In some implementations, the original time length of the load data period PLD2 is arranged to be equal to the first time length and thus does not to be adjusted when charge sharing does not occur. And since the original time length of the load data period PLED is arranged to be equal to the "first time length," it needs to be extended to be the second time length when charge sharing occurs. In some other implementations, the original time length of the load data period PLED is to be unequal to the "first time length" and thus needs to be adjusted when charge sharing does not occur. For example, the original time length of the load data period PLED can be arranged to be equal to the "second time length" longer than the first time length and thus needs to be shortened to be the first time length when the charge sharing does not occur. And since the original time length of the load data period PLED is arranged to be equal to the "second time length," it does not need to be adjusted when the charge sharing occurs.

When the charge sharing operation is not performed on the data lines of the display panel 440 in the load data period (e.g., PLD2), the source driver circuit 420 may configure a time length of a corresponding line driving period (e.g., PDD2) to be a "third time length". When the charge sharing operation is performed on the data lines of the display panel 440 in the load data period (e.g., PLD1), the source driver circuit 420 may configure a time length of a corresponding line driving period (e.g., PDD1) to a "fourth time length". The "third time length" and the "fourth time length" may be determined based on a design requirement, wherein the "third time length" is longer than the "fourth time length".

In summary, the source driver circuit 420 may dynamically determine/configure the time length of the load data period (e.g., PLD1 or PLD2) and/or the time lengths of the line driving period (e.g., PDD1 or PDD2) at least based on whether charge sharing occurs or not, which may be under a presumption that a summation length of the first time length and the third time length is equal to a summation length of the second time length and the fourth time length. In some embodiments, the source driver circuit 420 may extend the time length of the load data period and shorten the time length of the line driving period when charge sharing occurs, and maintain both the time length of the load data period and the time length of the line driving period when charge sharing does not occur. In some other embodiments, the source driver circuit 420 may maintain both the time length of the load data period and the time length of the line driving period to be respective original time lengths when charge sharing occurs, and shorten the time length of the load data period and extend the time length of the line driving period when charge sharing does not occur. In each implementations, the driving level during the ling driving period can be compensated based on the time length of the line driving period. Preferably, for a longer/shorter time length of the line driving period, a lower/higher driving voltage of a driving signal can be utilized.

A schematic waveform diagram illustrating voltages of nodes B3 and B4 which are far away from the source driver circuit 420 in the plurality of data lines of the display panel 440 is shown in the lower half of FIG. 6. The nodes B3 and B4 illustrated in FIG. 6 may be inferred with reference to the nodes B1 and B2 illustrated in FIG. 2 and thus, will not be repeatedly described. Because the load data period PLD1 in which the charge sharing occurs is extended, i.e., the time for the charge sharing is prolonged, the charge sharing operation of the nodes B3 and B4 in the plurality of data lines of the display panel 440 may be completed in time. Thus, the efficiency of the charge sharing may be sufficiently utilized.

In the embodiment illustrated in FIG. 6, the source driver circuit 420 may also dynamically determine the driving levels of the driving signals in the line driving periods according to whether the charge sharing occurs. When the charge sharing operation is not performed on at least two of the data lines of the display panel 440, the driving signals output by the source driver circuit 420 have first driving levels in the line driving periods. When the charge sharing operation is performed on at least two of the data lines, the driving signals output by the source driver circuit 420 have second driving levels higher than the first driving levels in the line driving periods.

For example (but not limited to), the timing controller circuit 410 may select a corresponding look-up table from a plurality of look-up tables according to the time length (i.e., the second time length) of the load data period PLD1 according to whether the charge sharing occurs. According to original pixel greyscale data of the load data period PLD1, the timing controller circuit 410 may obtain a compensation value from the corresponding look-up table. The timing controller circuit 410 may add the original pixel greyscale data by the compensation value to obtain compensated greyscale data. The timing controller circuit 410 may provide the compensated greyscale data in replacement for the original pixel greyscale data to the source driver circuit 420. Thus, the source driver circuit 420 may output a compensated driving signal (which is a driving signal added by a compensation component ΔV) to different data lines of the display panel 440 in the line driving period PDD1.

Figure 8:
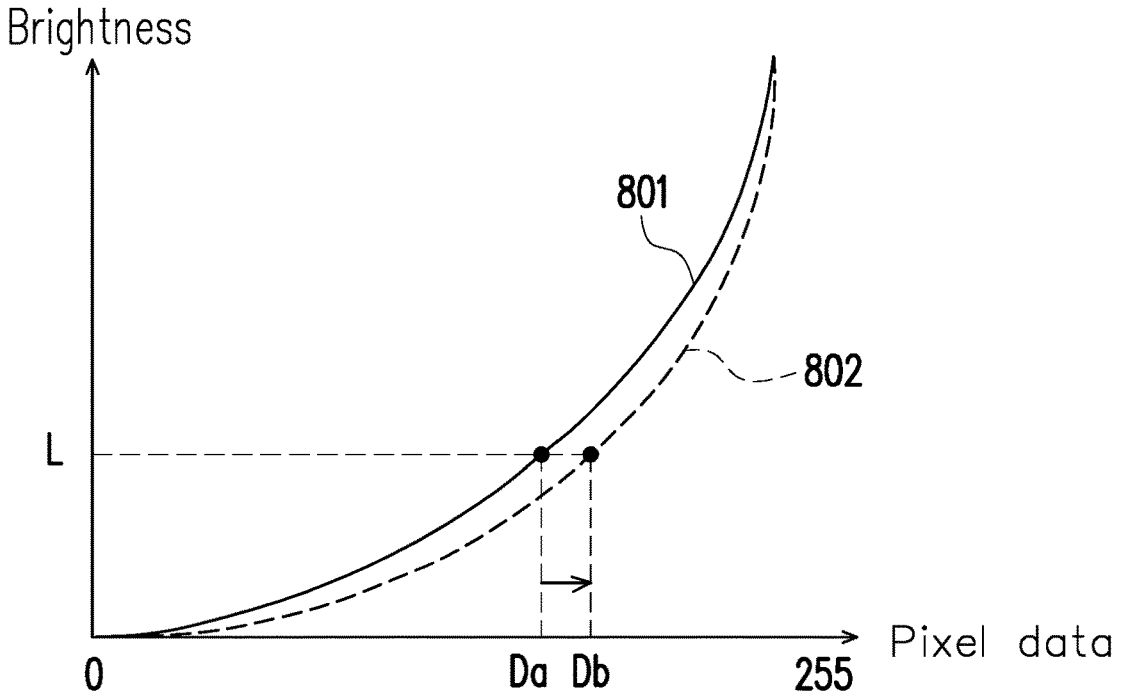
FIG. 8 is a graph illustrating a relationship between the pixel greyscale data and the brightness according to an embodiment of the present invention.

FIG. 8 is a graph illustrating a relationship between the pixel greyscale data and the brightness according to an embodiment of the present invention. The horizontal axis illustrated in FIG. 8 represents the pixel greyscale data. The vertical axis illustrated in FIG. 8 represents the brightness. A curve 801 illustrated in FIG. 8 represents a relationship curve corresponding to an original time length (which is a normal time length) in the load data period. A curve 802 illustrated in FIG. 8 represents a relationship curve corresponding to a new time length (which is an extended time length) in the load data period. According to the curve 801, a brightness corresponding to the original pixel greyscale data Da is L. It is assumed herein that the extended load data period applies the curve 802. When the load data period is extended, in order to maintain the brightness at L, the source driver circuit 420 may obtain compensated greyscale data DU from the curve 802. When the charge sharing operation is performed on the data lines of the display panel 440, the timing controller circuit 420 may replace the original pixel greyscale data Da with the compensated greyscale data Db.

Figure 9:
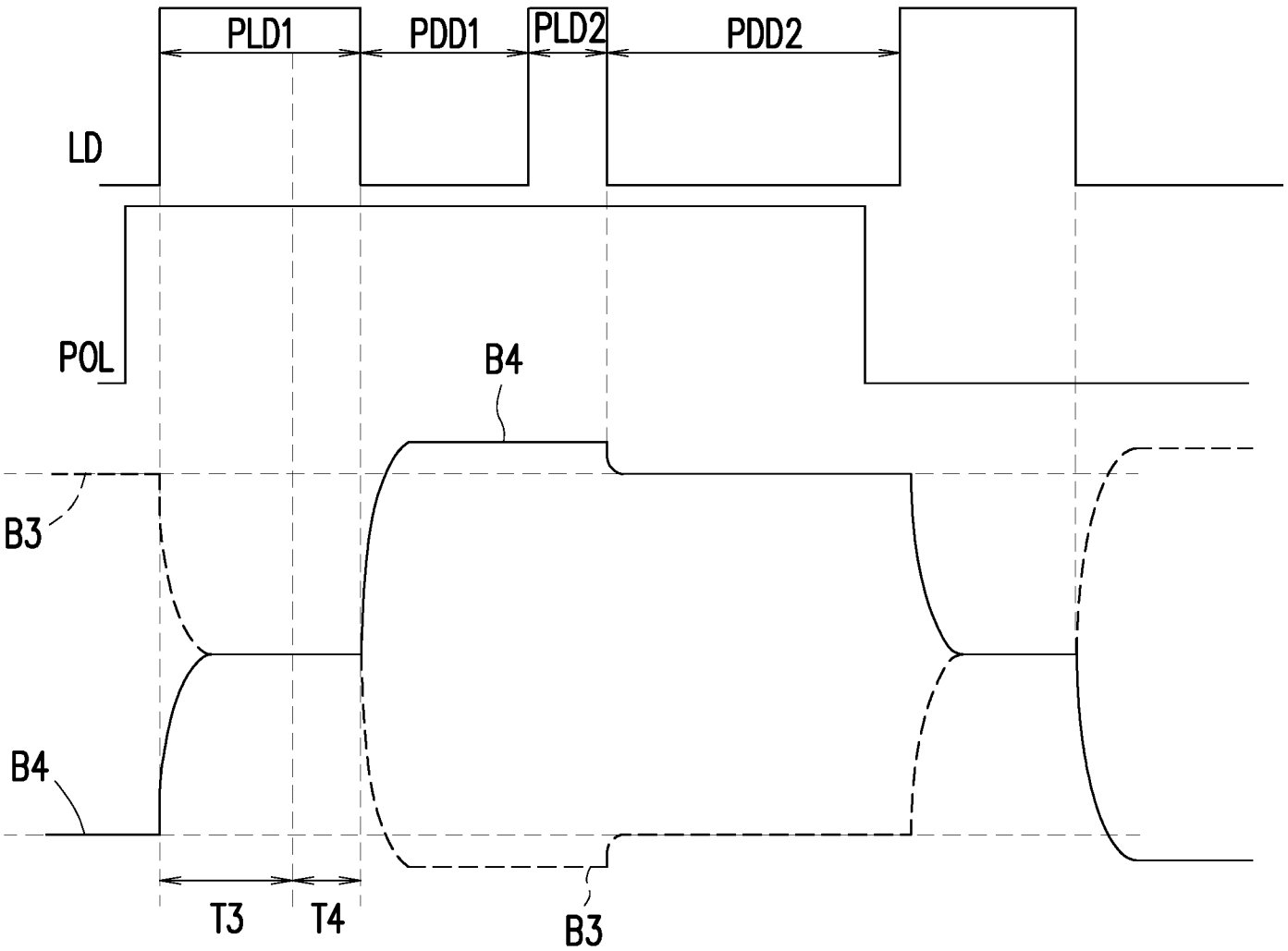
FIG. 9 is a schematic waveform diagram illustrating the load data signal and the polarity signal depicted in FIG. 4 according to another embodiment of the invention.

FIG. 9 is a schematic waveform diagram illustrating the load data signal LD and the polarity signal POL depicted in FIG. 4 according to another embodiment of the invention. The source driver circuit 420 may drive the plurality of data lines of the display panel 440 by using a plurality of operational amplifiers (which are not shown). It is assumed that the charge sharing occurs in the load data period PLD1. The load data period PLD1 may be divided into a first sub period T3 and a second sub period T4. The power is stopped from being supplied (or the power is decreasingly supplied) to the operation amplifiers (not shown) of the source driver circuit 420 in the first sub period T3 or restored to be supplied (or normally supplied) in the second sub period T4.

Figure 10:
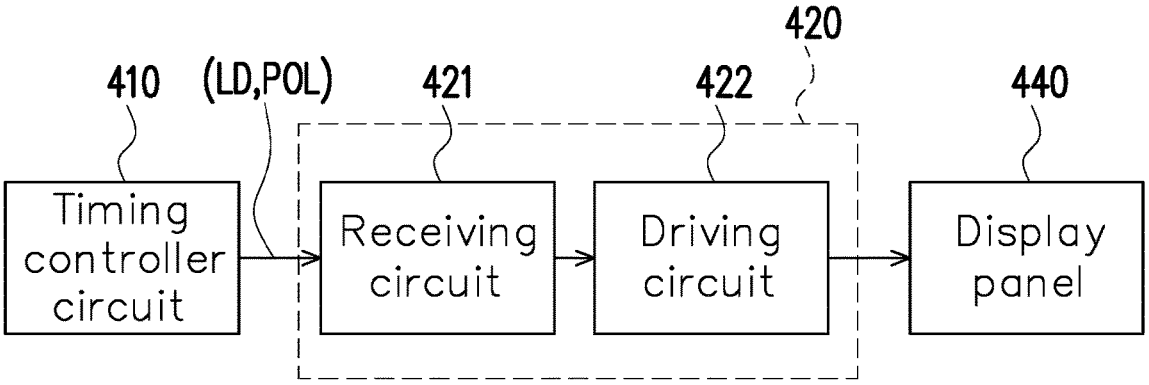
FIG. 10 is a schematic circuit block diagram illustrating the source driver circuit depicted in FIG. 4 according to an embodiment of the invention.

FIG. 10 is a schematic circuit block diagram illustrating the source driver circuit 420 depicted in FIG. 4 according to an embodiment of the invention. The source driver circuit 420 includes a receiving circuit 421 and a driving circuit 422. The receiving circuit 421 may receive the polarity signal POL and the load data signal LD from the timing controller circuit 410. The polarity signal POL indicates whether the charge sharing operation is performed on at least two of the data lines of the display panel 440. A same frame period of the load data signal LD includes a plurality of load data periods, and the source driver circuit 420 loads data in the load data periods. The driving circuit 422 is connected between the receiving circuit 421 and the plurality of data lines of the display panel 440. When the polarity signal POL indicates that the charge sharing operation is not performed on at least two of the data lines in certain one of the load data periods (for example, the load data period PLD2 as illustrated in FIG. 6), the driving circuit 422 does not extend the load data period PLD2, such that the load data period PLD2 has the first time length (which is the original time length). When the polarity signal POL indicates that the charge sharing operation is performed on at least two of the data lines in certain one of the load data periods (for example, the load data period PLD1 as illustrated in FIG. 6), the driving circuit 422 extends the load data period PLD1 to have the second time length longer than the first time length.

Figure 11:
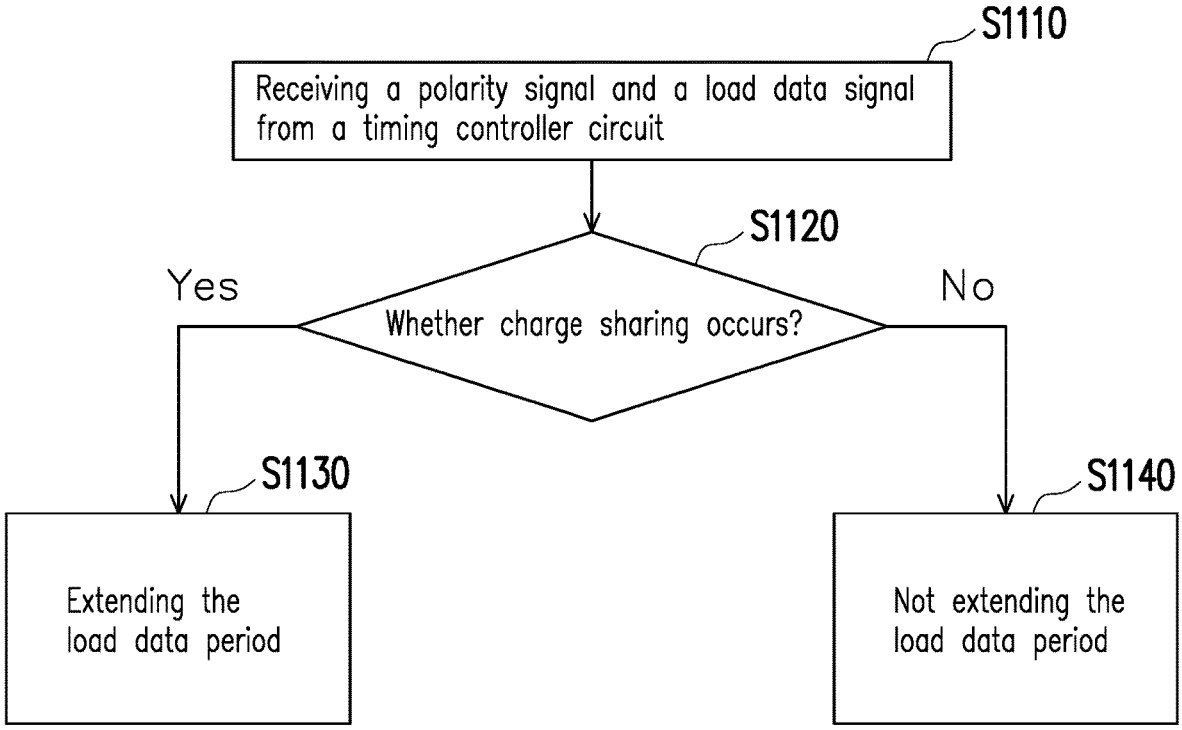
FIG. 11 is a flowchart illustrating a driving method of a display panel according to another embodiment of the invention.

FIG. 11 is a flowchart illustrating a driving method of a display panel according to another embodiment of the invention. In step S1110, the receiving circuit 421 may receive the polarity signal POL and the load data signal LD from the timing controller circuit 410. The driving circuit 422, in step S1120, may determine whether a charge sharing operation is to be performed according to the polarity signal POL. When the polarity signal POL indicates that the charge sharing operation is performed on the data lines (i.e., the determination result of step S1120 is "Yes"), the driving circuit 422 performs step S1130. In step S1130, the driving circuit 422 extends the current load data period. When the polarity signal POL indicates that the charge sharing operation is not performed on the data lines (i.e., the determination result of step S1120 is "No"), the driving circuit 422 does not extend the current load data period.

Figure 12:
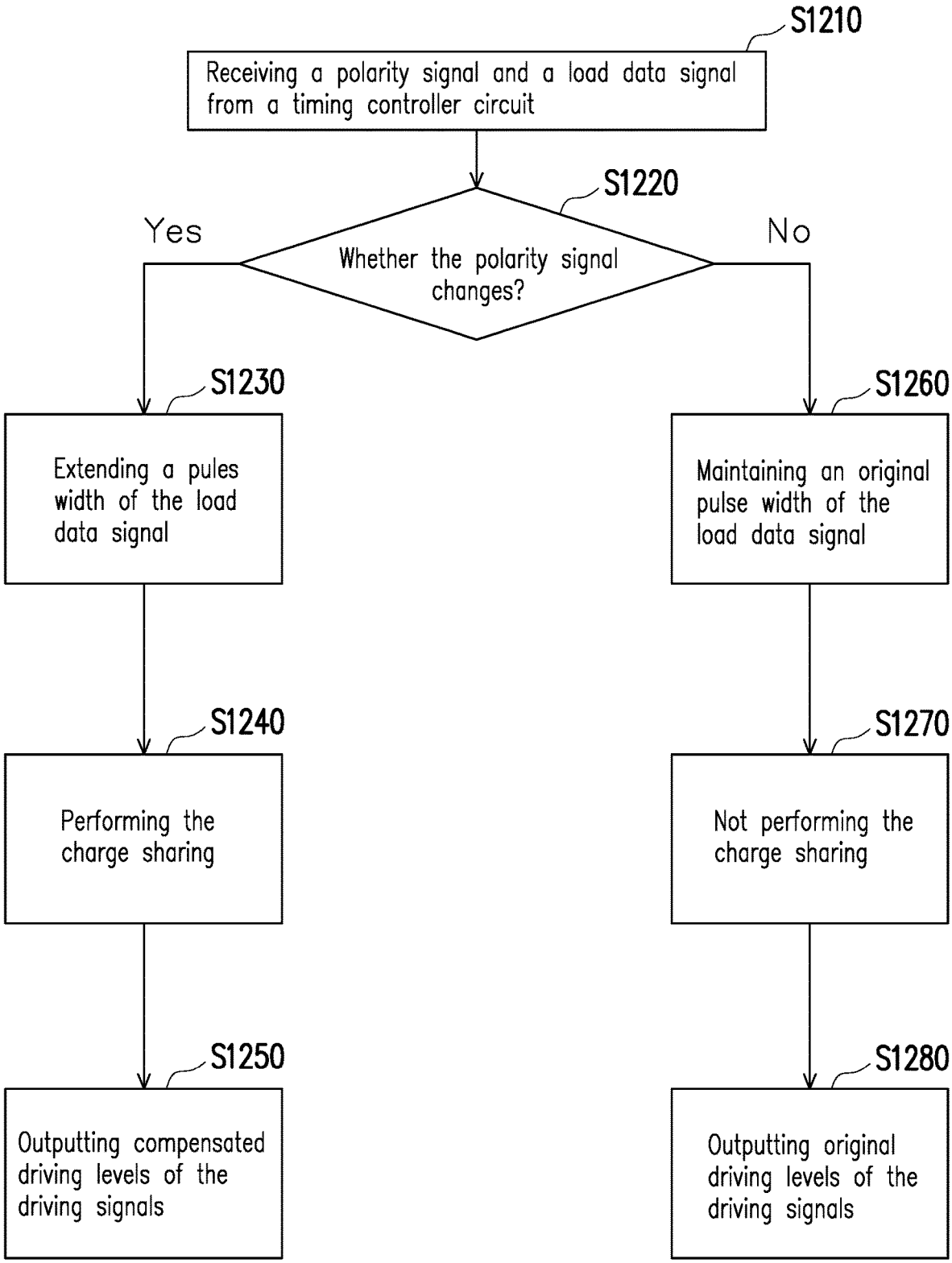
FIG. 12 is a flowchart illustrating a driving method of a display panel according to yet another embodiment of the invention.

FIG. 12 is a flowchart illustrating a driving method of a display panel according to yet another embodiment of the invention. In step S1210, the receiving circuit 421 may receive the polarity signal POL and the load data signal LD from the timing controller circuit 410. The driving circuit 422, in step S1220, may determine whether the polarity signal POL changes. When the polarity signal POL changes (i.e., the determination result of step S1220 is "Yes"), the driving circuit 422 performs step S1230. In step S1230, the driving circuit 422 extends a pulse width of the load data signal LD in the current load data period, which may shortened a time length of a current line driving period next to the current load data period. In step S1240, the driving circuit 422 performs the charge sharing operation in the current load data period. After the load data period ends (i.e., the charge sharing operation ends), in step S1250, the drive circuit 422 outputs compensated (for example, increased) driving levels (which are the second driving levels) of the driving signals to the data lines of the display panel 440 in the current line driving period.

When the polarity signal POL does not change (i.e., the determination result of step S1220 is "No"), the driving circuit 422 performs step S1260. In step S1260, the driving circuit 422 maintains an original pulse width of the load data signal LD in the current load data period. In step S1270, the driving circuit 422 does not perform the charge sharing operation in the current load data period. After the load data period ends, in step S1280, the drive circuit 422 outputs original driving levels (which are the first driving levels) of the driving signals to the data lines of the display panel 440 in the current line driving period.

In the embodiment, the time length of the load data period is extended and the time length of the line driving period is shortened accordingly when charge sharing occurs. In addition, both the time length of the load data period and the time length of the line driving period are not adjusted when charge sharing does not occur so as to be maintained shorter and longer respectively compared to the time lengths when charge sharing occurs. However, in some other embodiments, both the time length of the load data period and the time length of the line driving period can be maintained to be respective original time lengths when charge sharing occurs. And the time length of the load data period can be shorted and the time length of the line driving period can be extended when charge sharing does not occur, which can still be shorter and longer respectively compared to the time lengths when charge sharing occurs.

It should be noted that in different application scenarios, related functions of the timing controller circuit 410, the source driver circuit 420, the receiving circuit 421 and/or the driving circuit 422 may be implemented in a form of software, firmware or hardware by utilizing general programming languages (e.g., C or C++), hardware description languages (e.g., Verilog HDL or VHDL) or other suitable programming languages. The programming languages capable of executing the related functions may be deployed in any known computer-accessible media, such as magnetic tapes, semiconductor memories, magnetic discs or compact discs (e.g., CD-ROMs or DVD-ROMs) or may be transmitted through Internet, wired communication means, wireless communication means, or other communication media. The programming languages may be stored in an accessible medium of a computer, such that a processor of the computer may access/execute programming codes of the software (or firmware). In terms of hardware implementation, one or more controllers, micro-controllers, Application-specific integrated circuits (ASICs), digital signal processors (DSPs), field programmable gate arrays (FPGAs) and/or other various logic blocks, modules and circuits in other processing units may be employed to implement or execute the aforementioned functions of the embodiments of the invention. Moreover, the device and the method of the invention may be implemented by a combination of hardware and software.

Based on the above, the display panel driving apparatus and the driving method thereof provided by the embodiments of the invention can extend the load data period, so as to prolong the time for the charge sharing. Thus, the display panel driving apparatus can sufficiently utilize the efficiency of the charge sharing.

Although the invention has been disclosed by the above embodiments, they are not intended to limit the invention. It will be apparent to one of ordinary skill in the art that modifications and variations to the invention may be made without departing from the spirit and scope of the invention. Therefore, the scope of the invention will be defined by the appended claims.

What is claimed is:

1. A display panel driving apparatus, comprising:

a source driver circuit, configured to be coupled to a plurality of data lines of a display panel, wherein a same frame period comprises a first horizontal period and a second horizontal period, the first horizontal period has a first load data period, the second horizontal period has a second load data period and the source driver circuit loads a plurality of data to the data lines of the display panel in the first and second load data periods; and a timing controller circuit, configured to control the source driver circuit, wherein the timing controller circuit dynamically configures time lengths of the first and second load data periods according to whether charge sharing occurs, wherein the first load data period has a first time length when a charge sharing operation is not performed, and the second load data period has a second time length longer than the first time length when the charge sharing operation is performed, wherein the first and second horizontal periods have the same time lengths.

2. The display panel driving apparatus according to claim 1, wherein the same frame period further comprises a first and second line driving periods immediately next to the first and second load data periods respectively, wherein in the first and second line driving periods, the source driver circuit provides a plurality of driving signals for driving the data lines to enable the display panel to display an image based on the plurality of data loaded in the first and second load data periods.

3. The display panel driving apparatus according to claim 2, wherein the source driver circuit further dynamically configures time lengths of the first and second line driving periods according to whether the charge sharing occurs, wherein the first line driving period has a third time length when the charge sharing operation is not performed, and the second line driving period has a fourth time length longer than the third time length when the charge sharing operation is performed.

4. The display panel driving apparatus according to claim 2, wherein the source driver circuit further dynamically determines driving levels of the driving signals in the first and second line driving periods according to whether the charge sharing occurs, wherein the driving signals have a plurality of first driving levels when the charge sharing operation is not performed, and the driving signals have a plurality of second driving levels higher than the first driving levels when the charge sharing operation is performed.

5. The display panel driving apparatus according to claim 2, wherein the timing controller circuit further outputs a load data signal transiting between a first level and a second level, wherein the first level indicates the first load data period, and the second level indicates the second line driving period.

6. The display panel driving apparatus according to claim 5, wherein the timing controller circuit further outputs a polarity signal indicating whether a charge sharing is performed or not, and the source driver circuit configures the first and second time lengths of the first and second load data period of the load data signal in response to the polarity signal.

7. The display panel driving apparatus according to claim 6, wherein the source driver circuit detects whether the polarity signal changes at a rising edge of the load data signal, and configures the first and second time lengths of the first and second load data periods of the load data signal in response to the detection.

8. The display panel driving apparatus according to claim 1, wherein the timing controller circuit obtains the second time length from a look-up table according to an input current of the timing controller circuit.

9. The display panel driving apparatus according to claim 1, wherein the timing controller circuit selects a corresponding look-up table from a plurality of look-up tables according to the second time length;

the timing controller circuit obtains a compensation value from the look-up table according to original pixel greyscale data of the load data period; and the timing controller circuit adds the original pixel greyscale data by the compensation value to obtain compensated greyscale data and provides the compensated greyscale data in replacement for the original pixel greyscale data to the source driver circuit.

10. A source driver circuit, comprising:

a receiving circuit, receiving a polarity signal and a load data signal from a timing controller circuit, wherein the polarity signal indicates whether a charge sharing operation is performed or not, wherein a same frame period of the load data signal comprises a first horizontal period and a second horizontal period, the first horizontal period has a first load data period, the second horizontal period has a second load data period in which the source driver circuit loads data; and a driving circuit, configured to be connected between the receiving circuit and a plurality of data lines of the display panel, wherein when the polarity signal indicates that a charge sharing operation is not performed, the driving circuit does not extend the first load data period, such that the first load data period has a first time length, and when the polarity signal indicates that the charge sharing operation is performed, the driving circuit extends the second load data period to have a second time length longer than the first time length, wherein the first and second horizontal periods have the same time lengths.

11. A driving method of a display panel, comprising:

loading data to a plurality of data lines of the display panel in a first and second load data periods respectively of a first and second horizontal periods of a same frame period; and dynamically configuring time lengths of the first and second load data periods according to whether charge sharing occurs, wherein the first load data period has a first time length when a charge sharing operation is not performed, and the second load data period has a second time length longer than the first time length when the charge sharing operation is performed, wherein the first and second horizontal periods have the same time lengths.

12. The driving method according to claim 11, wherein the same frame period further comprises a first and second line driving periods immediately next to the first and second load data periods respectively, and the driving method further comprises:

in the first and second line driving periods, providing a plurality of driving signals for driving the data lines to enable the display panel to display an image based on the plurality of data loaded in the first and second load data periods.

13. The driving method according to claim 12, further comprising:

dynamically configuring time lengths of the first and second line driving periods according to whether the charge sharing occurs, wherein the first line driving period has a third time length when the charge sharing operation is not performed, and the second line driving period has a fourth time length longer than the third time length when the charge sharing operation is performed.

14. The driving method according to claim 12, further comprising:

dynamically determining driving levels of the driving signals in the first and second line driving periods according to whether the charge sharing occurs, wherein the driving signals have a plurality of first driving levels when a charge sharing operation is not performed, and the driving signals have a plurality of second driving levels higher than the first driving levels when the charge sharing operation is performed.

15. The driving method according to claim 12, further comprising:

providing a load data signal transiting between a first level and a second level, wherein the first level indicates the first load data period, and the second level indicates the second line driving period.

16. The driving method according to claim 15, further comprising:

providing a polarity signal indicating whether a charge sharing is performed or not; and configuring the first and second time lengths of the first and second load data periods of the load data signal in response to the polarity signal.

17. The driving method according to claim 16, further comprising:

detecting whether the polarity signal changes at a rising edge of the load data signal; and configuring the first and second time lengths of the first and second load data periods of the load data signal in response to the detection.

18. The driving method according to claim 11, further comprising:

obtaining the second time length from a look-up table according to an input current of the timing controller circuit.

19. The driving method according to claim 11, further comprising:

selecting a corresponding look-up table from a plurality of look-up tables according to the second time length;

obtaining a compensation value from the look-up table according to original pixel greyscale data of the load data period;

adding the original pixel greyscale data by the compensation value to obtain compensated greyscale data; and providing the compensated greyscale data in replacement for the original pixel greyscale data to the source driver circuit.

20. A driving method of a display panel, comprising:

receiving a polarity signal and a load data signal from a timing controller circuit, wherein the polarity signal indicates whether a charge sharing operation is performed on at least two of data lines of the display panel or not, wherein one frame period of the load data signal comprises a first horizontal period and a second horizontal period, the first horizontal period has a first load data period, the second horizontal period has a second load data period, and the source driver circuit loads data in the first and second load data periods;

when the polarity signal indicates that the charge sharing operation is not performed, not extending the first load data period, such that the first load data period has a first time length; and when the polarity signal indicates that the charge sharing operation is performed, extending the second load data period, such that the second load data period has a second time length longer than the first time length, wherein the first and second horizontal periods have the same time lengths.

* * * * *